US008574489B2

(12) United States Patent
Narasimhan

(10) Patent No.: US 8,574,489 B2
(45) Date of Patent: Nov. 5, 2013

(54) COMPACTION METHODS

(75) Inventor: Kalathur S. Narasimhan, Moorestown, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 98 days.

(21) Appl. No.: 13/102,110

(22) Filed: May 6, 2011

(65) Prior Publication Data

US 2011/0274577 A1 Nov. 10, 2011

Related U.S. Application Data

(60) Provisional application No. 61/332,431, filed on May 7, 2010.

(51) Int. Cl.
*B22F 3/12* (2006.01)
*B22F 3/24* (2006.01)

(52) U.S. Cl.
USPC ..... 419/28; 419/39; 419/66; 75/246

(58) Field of Classification Search
USPC ..... 419/26, 28
See application file for complete search history.

(56) References Cited

U.S. PATENT DOCUMENTS

| | | | | |
|---|---|---|---|---|
| 5,330,792 | A | 7/1994 | Johnson et al. | |
| 5,368,630 | A | 11/1994 | Luk | |
| 5,498,276 | A | 3/1996 | Luk | |
| 6,126,894 | A * | 10/2000 | Moxson | 419/2 |
| 6,348,265 | B1 | 2/2002 | Jansson et al. | |

FOREIGN PATENT DOCUMENTS

| | | | |
|---|---|---|---|
| EP | 0457418 | A1 | 11/1991 |
| EP | 1820587 | A1 | 8/2007 |
| WO | 2009136854 | A1 | 11/2009 |

* cited by examiner

*Primary Examiner* — Roy King
*Assistant Examiner* — Christopher Kessler
(74) *Attorney, Agent, or Firm* — Woodcock Washburn LLP

(57) ABSTRACT

The present invention is directed to improved compaction techniques for use in powder metallurgical applications using lower temperatures and pressures than are traditionally used in the field.

7 Claims, 5 Drawing Sheets

COMPACTION METHODS

CROSS REFERENCE TO RELATED APPLICATIONS

This application claims the benefit of U.S. Provisional Application No. 61/332,431, filed May 7, 2010, the entirety of which is incorporated herein.

TECHNICAL FIELD

The present invention is directed to improved compaction techniques for use in powder metallurgical applications that use lower temperatures and pressures than are traditionally used in the field.

BACKGROUND

Compacted parts made from insulated iron powders are a convenient alternative to lamination steels in alternating current (AC) applications. Traditionally, compacted parts for powder metal electromagnetic alternating current applications are manufactured using compaction pressures as high as 1600-2000 MPa in order to achieve a high density of the resulting green compacted part. These high compaction forces oftentimes damage the mechanical parts of the compaction device, particularly those used to make parts with complex geometries.

To achieve higher densities in powder metal parts for non-electromagnetic AC applications, the green compact is heated at temperatures in excess of 650° C. in order to remove the lubricant, followed by recompaction at compaction pressures of 600-800 MPa. Higher densities are thus by achieved by re-compacting metal to fill all the voids left by the eliminated lubricant.

For electromagnetic AC applications, however, a coating is typically applied on the metal powder to eliminate metal-to-metal contact. These coatings cannot withstand the excessive temperatures typically used for lubricant removal.

As such, what are needed are compaction methods for insulated powders that use lower compaction pressures and lower lubricant-removal temperatures, while maintaining high densities of the compacted part.

SUMMARY

Methods of compacting powder metallurgical compositions comprising compacting an iron-based powder metallurgical composition using a pressure of about 800 MPa or less to form a green compact; heating the green compact at a temperature of less than about 600° C.; and re-compacting the green compact at a pressure of about 800 MPa or less to form a compacted part are described. Compacted parts made according to these methods are also described.

DETAILED DESCRIPTION OF ILLUSTRATIVE EMBODIMENTS

Figure 1:
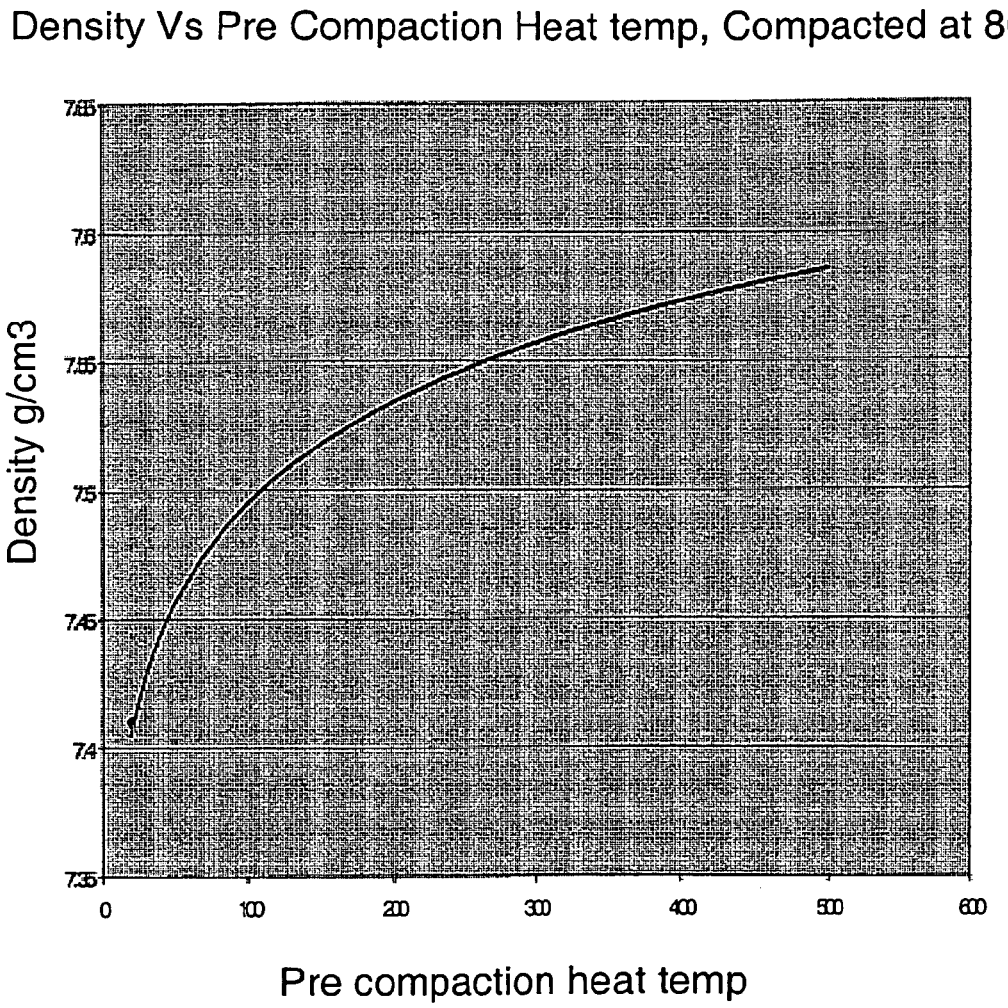
FIG. 1 shows, for one embodiment of the invention, the effects of pre-compaction temperature on density of the green parts after the second compaction.

It has been discovered that high-density compacted parts can be obtained with powder metallurgical (PM) processes using compaction pressures as low at 800 MPa and lubricant-removal temperatures as low as 300° C. It has also been discovered that not only can high densities be achieved with lower pressures and lower temperatures than conventionally employed in the powder metallurgical arts, but also the resulting compacted parts have high electrical resistivity and low core loss.

As used herein, "resistivity" is a measure of how strongly a material opposes the flow of electric current. In PM AC applications, resistively is often sought to be maximized.

As used herein, "core loss" is the amount of magnetic energy from an applied alternating magnetic field that is lost to (converted into) heat per unit weight of a magnetic material subjected to that applied field. In PM AC applications, core loss should be minimized.

The powder metallurgical processes to which the present invention is directed generally use iron based metallurgical powders. Examples of iron-based metallurgical powders, as that term is used herein, are powders of substantially pure iron, powders of iron pre-alloyed with other elements (for example, steel-producing elements) that enhance the strength, electromagnetic properties, or other desirable properties of the final product, and powders of iron to which such other elements have been diffusion bonded. The iron based powder can be a mix of an atomized iron powder and a sponge iron, or other type of iron powder.

Substantially pure iron powders are powders of iron containing not more than about 1.0% by weight, preferably no more than about 0.5% by weight, of normal impurities. These substantially pure iron powders are preferably atomized powders prepared by atomization techniques. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85-3.00 g/cm$^3$, typically 2.94 g/cm$^3$. Other substantially pure iron powders that can be used in the invention are typical sponge iron powders, such as Hoeganaes' ANCOR MH-100 powder.

The iron-based powder can incorporate one or more alloying elements that enhance the mechanical or other properties of the final metal part. Such iron-based powders can be powders of iron, preferably substantially pure iron, that have been blended or pre-alloyed with one or more such elements. Useable iron based powders also include combinations of pure iron powders and pre-alloyed powders. Pre-alloyed iron based powders are prepared by making a melt of iron and the desired alloying elements, and then atomizing the melt, whereby the atomized droplets form the powder upon solidification.

Examples of alloying elements that can be pre-alloyed with iron, or blended with pure and/or pre-alloyed iron powders, include, but are not limited to, molybdenum, manganese, magnesium, silicon, nickel, vanadium, columbium (niobium), phosphorus, and combinations thereof. Preferred alloying elements are molybdenum, phosphorus, nickel, silicon, and combinations thereof. The amount of the alloying element or elements incorporated depends upon the properties desired in the final metal part. Pre-alloyed iron powders that incorporate such alloying elements are available from Hoeganaes Corp. as part of its ANCORSTEEL line of powders.

A further example of alloyed iron-based powders are diffusion-bonded iron-based powders, which are particles of substantially pure iron that have a layer or coating of one or more other alloying elements or metals, such as steel-producing elements, diffused into their outer surfaces. A typical process for making such powders is to atomize a melt of iron and then combine this atomized powder with the alloying powders and anneal this powder mixture in a furnace.

The iron-based powders that are useful in the practice of the invention also include stainless steel powders. These stainless steel powders are commercially available in various grades in the Hoeganaes ANCOR® series, such as the ANCOR® 410L, 430L, 434L, and 409Cb powders.

Other iron powders also useful in the invention are powders screened to different particle size fractions, for example 400 microns to 150 microns, 400 microns to 105 microns, 177 microns to 105 microns, 105 microns to 5 microns, 44 microns to 5 microns, or various combinations thereof. Those skilled in the art will readily recognized the appropriate particle size for use in a particular application.

The iron powders of the invention constitute a major portion of the metallurgical powder compositions described herein, and generally constitute at least about 85 weight percent, preferably at least about 90 weight percent, and more preferably at least about 95 weight percent of the metallurgical powder composition.

A metal phosphate coating substantially, completely, or at least partially covers the iron-based powders, optional alloying powders, or both. Metal phosphates include any metal phosphate known to those skilled in the art. Metal phosphates include, for example, manganese phosphate, nickel phosphate, zinc phosphate, copper phosphate, and combinations thereof. Preferably, the metal phosphate is zinc phosphate.

The metallurgical powder compositions of the invention include from about 0.01 to about 1 weight percent of metal phosphate. Preferably, metallurgical powder compositions include from about 0.05 to about 0.40 weight percent of the metal phosphate. More preferably, metallurgical powder compositions include from about 0.05 to about 0.20 weight percent of the metal phosphate. Metallurgical powder compositions are generally prepared in a "one step" or "two step" process. The "one step" process involves admixing a base metal powder, metal phosphate, a particulate internal lubricant, and any optional alloying powders, and additives that will form the metallurgical powder composition. The admixture is then combined with the protonic acid to react and form a metal phosphate coating on the component powders. In one embodiment, the metal phosphate layer is formed at the same time that the particles are being bonded together with a binder. The "one step" process saves time and related expense in manufacturing processes, especially large scale processes for fabricating commercial quantities of metallurgical powder compositions.

The "two step" process involves forming a metal phosphate coating on the metal based powders prior to admixing with the particulate internal lubricant and optional additives that will form the metallurgical powder composition. First, the base-metal powders, optionally alloying powders, or combination of both, are admixed with the metal phosphate. The admixture is then combined with the protonic acid to react to form a metal phosphate coating on the admixture of powders. The coated admixture is then combined with the particulate internal lubricant and any additional optional alloying powders or additives, e.g., binders, resins, and the like.

Protonic acids are any substance that can donate a hydrogen ion (proton). Exemplary protonic acids include, for example, but are not limited to, hydrochloric acid, nitric acid, sulfuric acid, acetic acid, phosphoric acid, and water. Preferably, the protonic acid is phosphoric acid, hydrochloric acid, sulfuric acid, or nitric acid. More preferably, the protonic acid is phosphoric acid.

Optionally, the protonic acid may diluted in a solvent prior to being combined with the admixture of base-metal powder and metal phosphate. Typical solvents include, for example, acetone, ethyl acetate, water, diethyl ether, dichloromethane, methanol, ethanol, and toluene. Preferably, the solvent is acetone. The solvent is removed from the admixture via conventional drying techniques, such as for example, vacuum techniques, heating the admixture to from about 100° F. to about 150° F., or combinations thereof.

Optionally, after the protonic acid and metal phosphate have reacted with base metal powder, the protonic acid is not removed so that the metallurgical powder compositions may include a small amount of excess protonic acid, such as for example from about 0.001 to about 0.2 weight percent of protonic acid.

Metallurgical powder compositions include particulate internal lubricants, whose presence reduces the ejection forces required to remove the compacted component form the compaction die cavity. Examples of such lubricants include stearate compounds, such as lithium, zinc, manganese, and calcium stearates, waxes such as ethylene bis-stearamides, polyethylene wax, and polyolefins, and mixtures of these types of lubricants. Other lubricants include those containing a polyether compound such as is described in U.S. Pat. No. 5,498,276 to Luk, and those useful at higher compaction temperatures described in U.S. Pat. No. 5,368,630 to Luk, in addition to those disclosed in U.S. Pat. No. 5,330,792 to Johnson et al., each of which is incorporated herein in its entirety by reference.

Compaction pressures used in the present invention are about 800 MPa or less. A compaction pressure of 800 MPa is preferred, although lower pressures, for example 750 MPa, 700 Mpa, 650 MPa, or 600 MPa can be used. These compaction pressures may be used in the first compaction step and/or the second compaction step. The pressure used in the re-compaction step can be greater than 800 MPa and can lead to higher densities. Furthermore, the pressure applied during the first compaction may be about the same or may be lower or higher than the pressure applied during subsequent compactions.

Temperatures applied to the compact in preferred embodiments of the invention are less than the conventional 600° C. Preferably, the temperature applied to remove at least a portion of the internal lubricant is up to about 400° C., although temperatures in the range of about 300° C. to about 400° C., more preferably about 350° C. or higher, can be used. Preferably, the green compacted part is cooled to a temperature below about 150° C., preferably to ambient temperature, before the second compaction step. It is also possible to compact the part at the cure temperature.

The invention may be further understood by reference to the following examples, which are intended to be illustrative of the invention only, and are not intended to be limiting.

EXAMPLES

Iron powder (ANCORSTEEL 1000C, Hoeganaes Corp., Riverton, N.J.) was screened through a U.S. mesh screen 140 mesh and the residual powder left on top of the screen was coated with zinc phosphate (0.2%, by weight of the iron powder) and admixed in a fluid bed with thermoplastic nylon powder (acrylic powder) (0.3%, by weight of the iron powder) and polyvinylalcohol (0.3%, by weight of the iron powder). The coated powder was blended with 0.2% of ethylene bis-stearamide lubricant. This powder was pressed at 800 MPa at a die temperature of 80° C. to form rectangular green compact and torroids that were heated to various temperatures. The pressed part was held at the indicated part temperature for 60 minutes under flowing nitrogen gas, cooled to ambient temperature, and repressed at 800 MPa. Density was measured using MPIF standard test method MPIF Standard 42. Resistivity was measured by the four-point probe technique ASTM Standard test method D257-07. Core less was measured on torroids using ASTM A773/A773M-01 test methods.

FIG. 1 shows the effects of pre-recompaction temperature on recompacted density.

Figure 2:
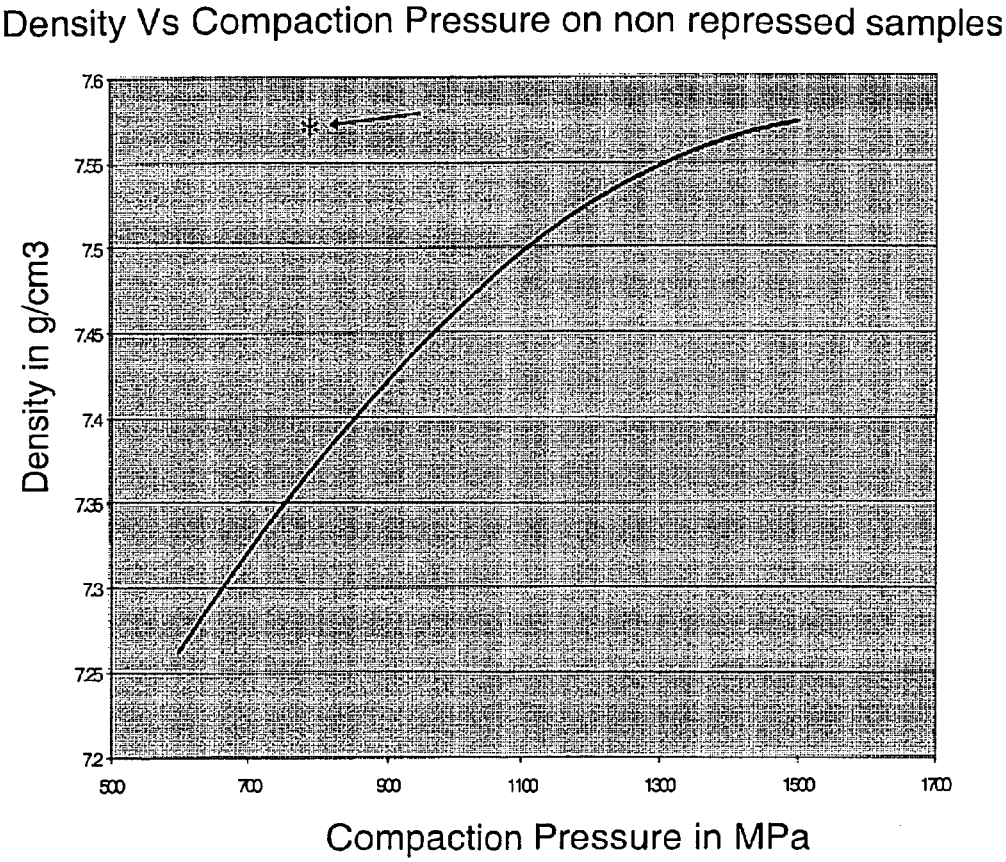
FIG. 2 shows the compaction pressure required to achieve high density using conventional compaction techniques. The density of a compact using one preferred method of the invention is also depicted.

FIG. 2 shows the compaction pressure required to achieve high densities using conventional compaction techniques. As depicted in FIG. 2, a pressure of at least 1500 MPa is required to achieve densities of 7.58 g/cm$^3$. Surprisingly, this density can be achieved by using the methods according to the invention, i.e., compaction pressure of about 800 MPa.

Figure 3:
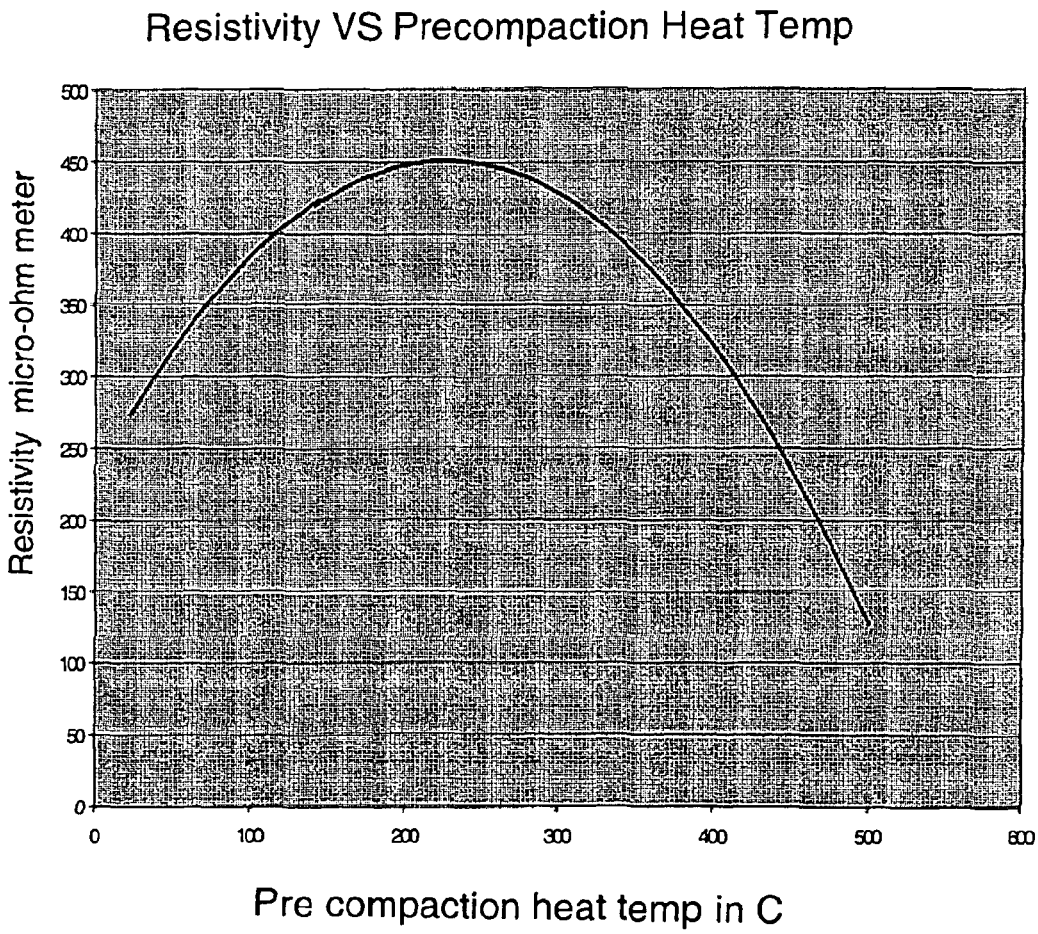
FIG. 3 depicts resistivity observed as a function of pre-recompaction temperature in one embodiment of the invention.

FIG. 3 depicts resistivity observed as a function of pre-recompaction temperature. As can be observed from FIG. 3, very high resistivity is observed at about 300° C.

Figure 4:
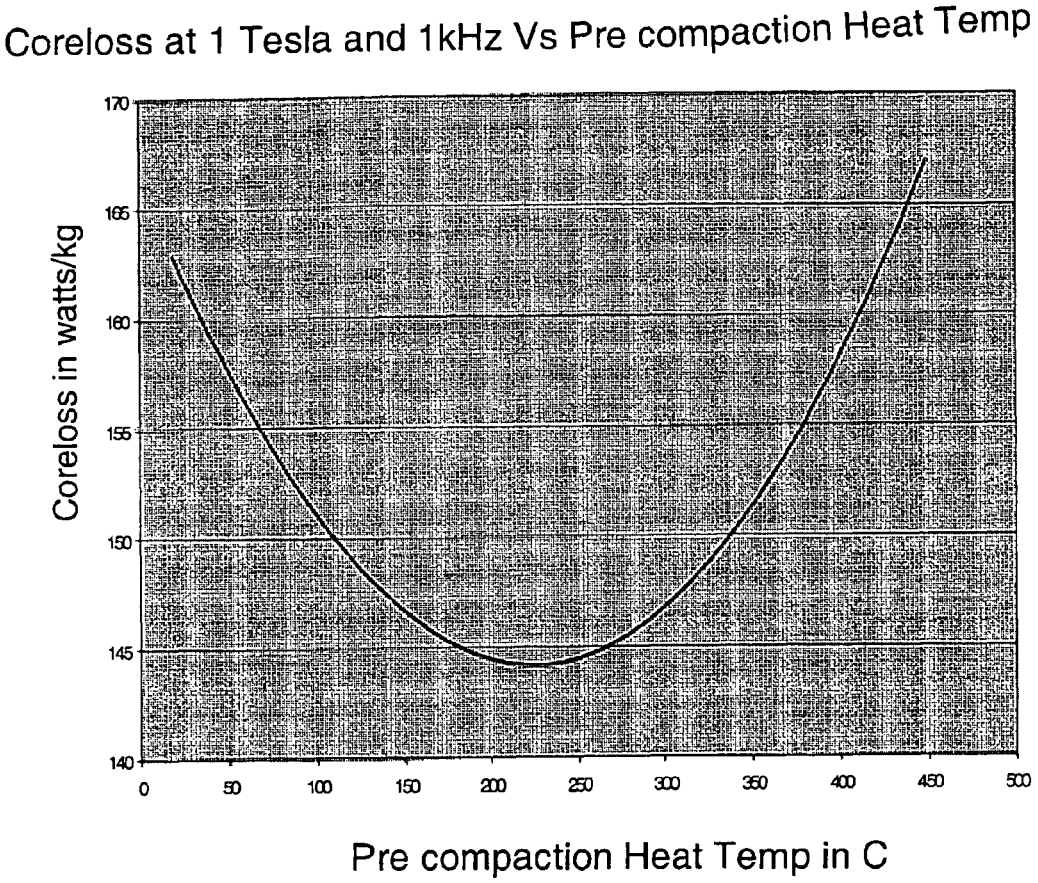
FIG. 4 depicts coreloss observed as a function of pre-recompaction temperature in one embodiment of the invention.

FIG. 4 depicts coreloss observed as a function of pre-recompaction temperature. As can be observed from FIG. 4, very low coreloss is observed at about 300° C.

Figure 5:
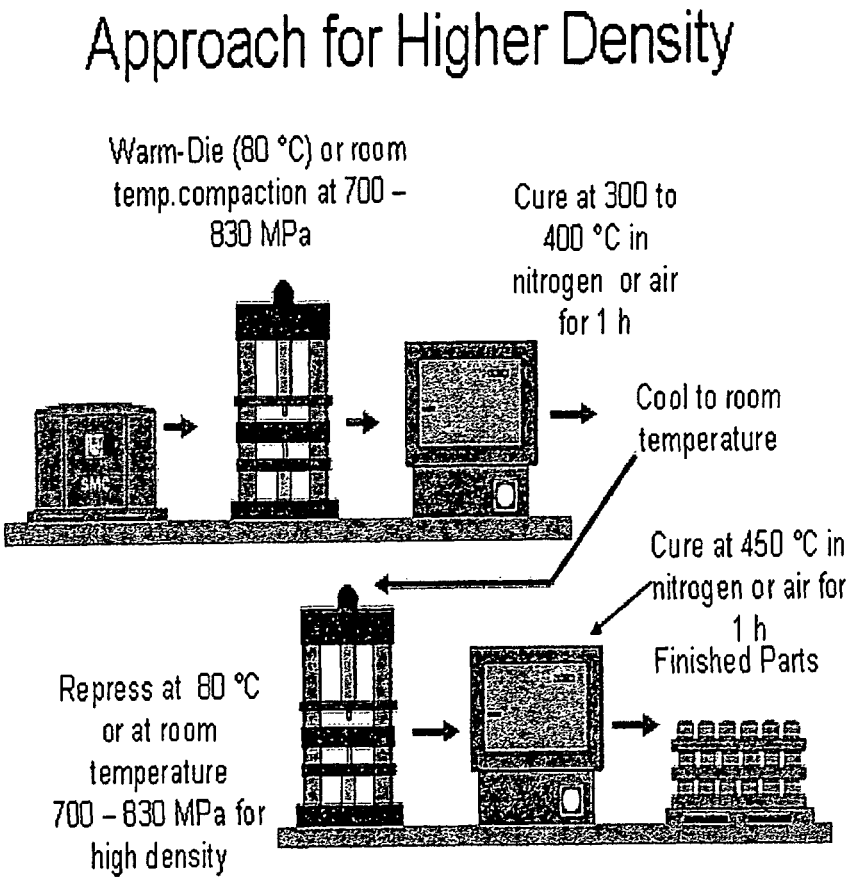
FIG. 5 depicts a flow diagram of one embodiment of the present invention.

FIG. 5 depicts a flow diagram of one embodiment of the present invention. The steps of this embodiment include (a) warm die (80° C.) or room temperature compacting at 700-830 MPa; (b) curing at 300 to 400° C. in a nitrogen or air atmosphere for 1 hour; (c) cooling to room temperature; (d) repressing at 80° C. or at room temperature at 700 to 830 MPa for high density; and (e) curing at 450° C. in a nitrogen or air atmosphere for 1 hour to produce a finished, compacted part.

What is claimed:

1. A method of compacting powder metallurgical compositions comprising compacting an iron-based powder metallurgical composition that comprises an iron-based powder and a lubricant, using a pressure of about 600 MPa to about 800 MPa to form a green compact;

heating the green compact at a temperature of about 300° C. to about 400° C.; and re-compacting the green compact at a pressure of at least 800 MPa to form a compacted part.

2. The method of claim 1, wherein the green compact is heated at a temperature above the melting point of the lubricant prior to the re-compaction step.

3. The method of claim 1, wherein the green compact is cooled to below 150° C. prior to the re-compacting step.

4. The method of claim 1, wherein the green compact is cooled to ambient temperature prior to the re-compaction step.

5. The method of claim 1, wherein the density of the compacted part is at least 7.5 g/cm$^3$.

6. The method of claim 1, wherein the resistivity of the compacted part is at least 350 micro-ohm-meter.

7. The method of claim 1, wherein the core loss of the compacted part is less than 150 watts/kg.

* * * * *